US005868364A

United States Patent [19]

MacMillan

[11] Patent Number: 5,868,364

[45] Date of Patent: Feb. 9, 1999

[54] BAG SUPPORT ASSEMBLY

[76] Inventor: Richard D. MacMillan, 267 Center Rd., Frankfort, Ill. 60423

[21] Appl. No.: 801,749

[22] Filed: Feb. 18, 1997

[51] Int. Cl.[6] ..... A47F 5/12

[52] U.S. Cl. ..... 248/97; 141/314; 141/391

[58] Field of Search ..... 248/97, 99, 55; 141/314, 391; 294/55

[56] References Cited

U.S. PATENT DOCUMENTS

| | | | |
|---|---|---|---|
| 2,172,529 | 9/1939 | Barkerr et al. | 248/97 |
| 4,139,029 | 2/1979 | Geraci | 141/391 X |
| 4,240,474 | 12/1980 | Perkins | 141/231 |
| 4,268,081 | 5/1981 | Hawkinson | 294/55 |
| 4,273,167 | 6/1981 | Stillwell | 141/314 |
| 4,470,627 | 9/1984 | Carroll et al. | 294/55 |
| 4,485,855 | 12/1984 | Dillingham | 141/316 |
| 4,537,376 | 8/1985 | Buku | 248/97 |
| 4,979,547 | 12/1990 | Hoerner | 141/390 |
| 5,048,778 | 9/1991 | Wright | 248/98 |
| 5,060,893 | 10/1991 | Halbert | 248/97 |
| 5,180,126 | 1/1993 | Bennett | 248/97 X |
| 5,406,777 | 4/1995 | Porto | 53/513 |
| 5,499,787 | 3/1996 | Bonomo | 248/97 |

*Primary Examiner*—Ramon O. Ramirez
*Attorney, Agent, or Firm*—Wildman, Harrold, Allen & Dixon

[57] ABSTRACT

A funnel (22) includes a liner (28) connected to a support structure (26). The funnel (22) is connected to a base (24) positioned within a trash bag (78) having an opening disposed around the support structure (26) at a discharge opening of the funnel (26). The liner (22) is detachable from the support structure (26) which is compressed for storage after being detached from the base (24). The liner (22) and base (24) are connected to the support structure (26) for storage. The components are packaged as a kit with adhesive so a purchaser can assemble the components.

13 Claims, 7 Drawing Sheets

50
46C
52
44
46B
56C
62
34
52
46A
38
38B
36
26
56
50
50
56B
64
62
38A
58C
40B
62
64
64
48C
56A
58B
54
64
58A
52
42
62
40A
48B
52
48A
50
24
74
25

BAG SUPPORT ASSEMBLY

BACKGROUND OF THE INVENTION

The present invention relates generally to a bag support assembly for supporting and filling a trash bag.

With the increasing need to be prudent from an ecological standpoint, trash including garden and lawn waste, such as grass clippings and leaves are collected in an ever increasing systematic fashion. Some governmental bodies, such as cities and municipalities, require that certain classes of trash, such as refuse or garden waste, be handled in a prescribed manner. For example, the collection, packaging and pick up of grass clippings and leaves separate from other household garbage is increasingly required.

Furthermore, in addition to common flexible plastic trash bags, the use of specific or authorized bags of a predetermined construction and size is frequently required. The bags may also be distributed by or on behalf of the city or municipality. One typical bag in use is of paper composition and has a 12 inch by 16 inch opening and is 36 inches in height. While a bag having these dimensions may be convenient for curbside pickup, it is not convenient for the homeowner attempting to fill it up in the yard of his or her home.

Attempts have been made to deal with the lack of rigidity associated with the plastic and paper trash bags and the difficulty in filling a trash bag with a small opening. The known attempts to provide a assembly to support a trash bag and channel trash into the opening of the bag, especially when the bag opening is small, have been cumbersome to market and ultimately use and store for the homeowner. Some assemblies do not provide a funnel or other devices to adequately direct the trash into the bag. While other assemblies include support structures which are inconveniently configured at the exterior of the bag and surrounding the bag.

The present invention is directed to overcoming or at least minimizing some of the problems mentioned above.

SUMMARY OF THE INVENTION

The problems are overcome by a bag support assembly in accordance with the present invention. In accordance with one aspect of the invention, a funnel is provided having an outer end for receiving trash and an inner end for discharging trash into a trash bag. The funnel is connected to a base connected to inner end of the funnel overlying an open end of the base, and the base is positioned within the trash bag.

Another aspect of the present invention includes a funnel having a support structure and a removable liner selectively attachable to the support structure of the funnel when the support structure is in an extended or open configuration. Upon removal of the liner and the base, the support structure is compressed to a low profile closed position from the extended or open configuration for storage.

Yet another aspect of the present invention provides a storage arrangement for attaching the liner and base to the support structure during storage of the bag support assembly.

A further feature of the invention is directed to a assembly for supporting and filling a trash bag that can be marketed in a kit and assembled by the homeowner.

BRIEF DESCRIPTION OF THE DRAWINGS

Other aspects and advantages of the present invention will become apparent upon reading the following detailed description and upon reference to the drawings, in which.

DESCRIPTION OF THE INVENTION

Figure 1:
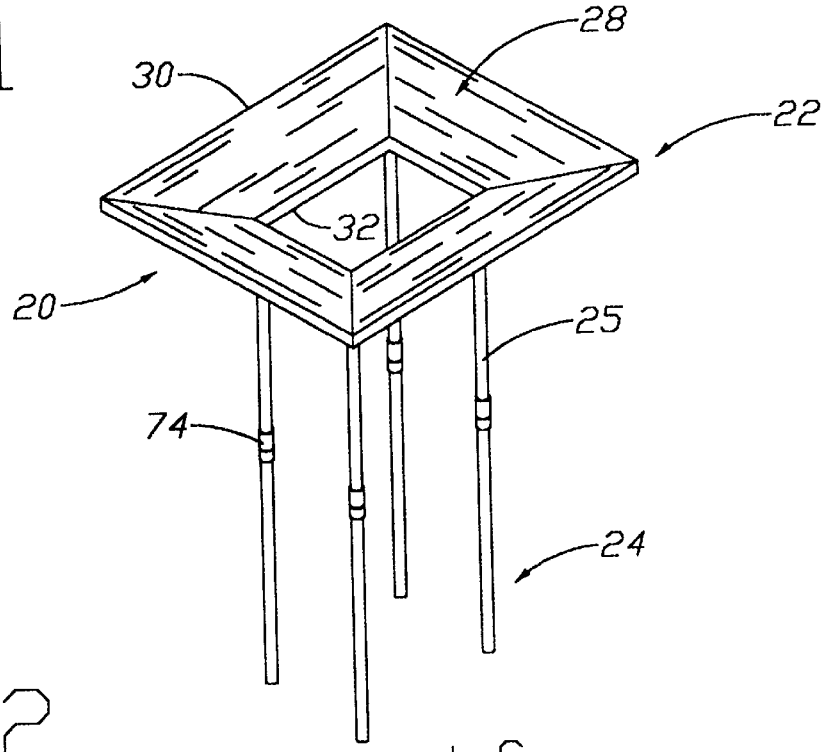
FIG. 1 is a perspective view of an improved assembly for supporting and filling a trash bag according to the present invention.
Figure 2:
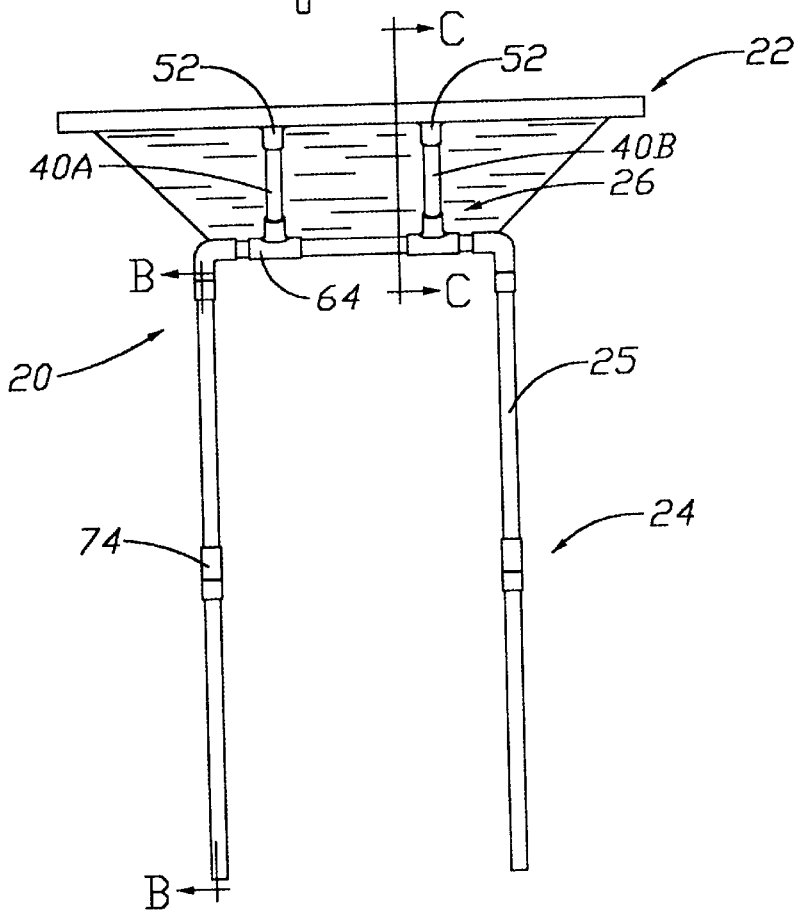
FIG. 2 is a side view of the improved assembly for supporting and filling a trash bag according to the present invention.

Turning now to the drawings and referring initially to FIGS. 1 and 2, a bag support assembly 20 for supporting and filling a trash bag is provided. The assembly 20 includes a funnel 22 and a base 24. The funnel 22 includes a support structure 26 and a continuous liner 28 connected to the support structure 26 for guiding trash from an outer end 30 to an inner end 32 of the funnel 22.

Figure 3:
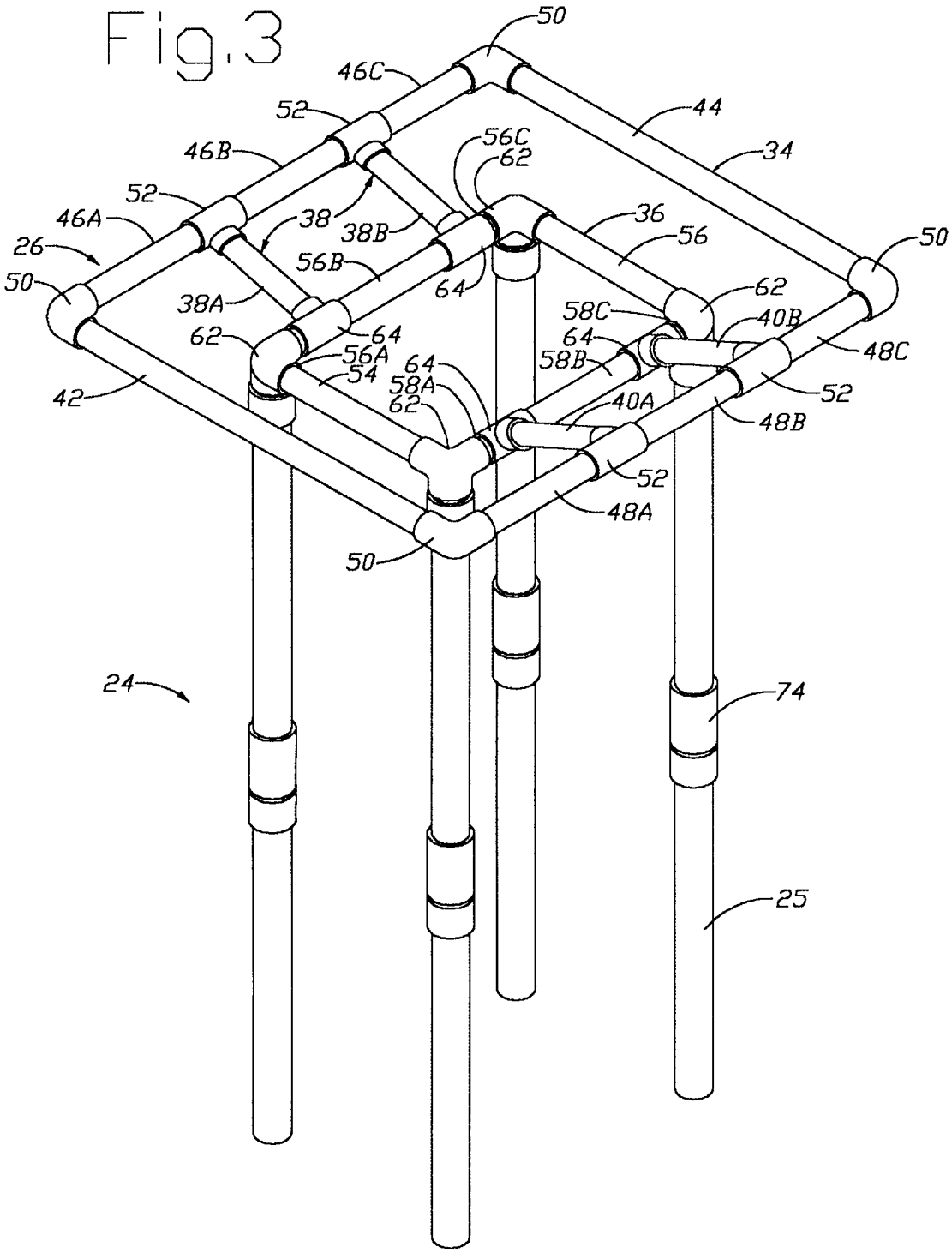
FIG. 3 is a perspective view of the improved assembly according to the present in invention having funnel panels removed.

As illustrated in FIG. 3, the assembly 20 is shown with the liner 28. removed. The base 24 and the support structure 26 are preferably constructed of polyvinyl chloride. The support structure 26 includes a outer rectangular member 34 and an inner rectangular member 36. The rectangular members 34 and 36 are connected by bridge members 38 and 40 each having a pair of tubular sections 38*a* and 38*b* and 40*a* and 40*b*, respectively. The base 24 has four legs 25 extending downward from the inner end 32 of the funnel 22.

As best seen in FIG. 3, the outer rectangular member 34 includes two parallel and opposed sides 42 and 44 and two parallel and opposed segments 46*a*, 46*b* and 46*c* and 48*a*, 48*b* and 48*c*. Opposed ends of side 42 are fixedly connected to an end of each segment 46*a* and 48*a*, respectively, in a ninety degree angle by elbow connectors 50. Opposed ends of side 44 are fixedly connected to an end of each segment 46*c* and 48*c*, respectively, in a ninety degree angle by elbow connectors 50.

The other ends of segments 46*a* and 46*c* are each pivotally connected to opposed ends of segment 46*b* by a pair of tee connectors 52 which are fixedly connected to segment 46*b* and pivotally connected to segments 46*a* and 46*c*. The other ends of segments 48*a* and 48*c* are each pivotally connected to opposed ends of segment 48*b* by a pair of tee connectors 52 which are fixedly connected to segment 48*b* and pivotally connected to segments 48*a* and 48*c*.

Further referring to FIG. 3, the inner rectangular member 36 includes two parallel and opposed sides 54 and 56 and two parallel and opposed segments 56*a*, 56*b* and 56*c* and 58*a*, 58*b* and 58*c*. Opposed ends of side 54 are fixedly connected to an end of each segment 56*a* and 58*a*, respectively, in a ninety degree angle by elbow connectors 62. Opposed ends of side 56 are securely connected to an end of each segment 56*c* and 58*c*, respectively, in a ninety degree angle by elbow connectors 62.

The other ends of segments 56*a* and 56*c* are each pivotally connected to opposed ends of segment 56*b* by a pair of tee connectors 64 which are fixedly connected to segment 56*b* and pivotally connected to segments 56*a* and 56*c*. The other ends of segments 58*b* and 58*c* are each pivotally connected to opposed ends of segment 58*b* by a pair of tee connectors 64 which are fixedly securely connected to segment 58*b* and pivotally connected to segments 59*a* and 58*c*.

Figure 4:
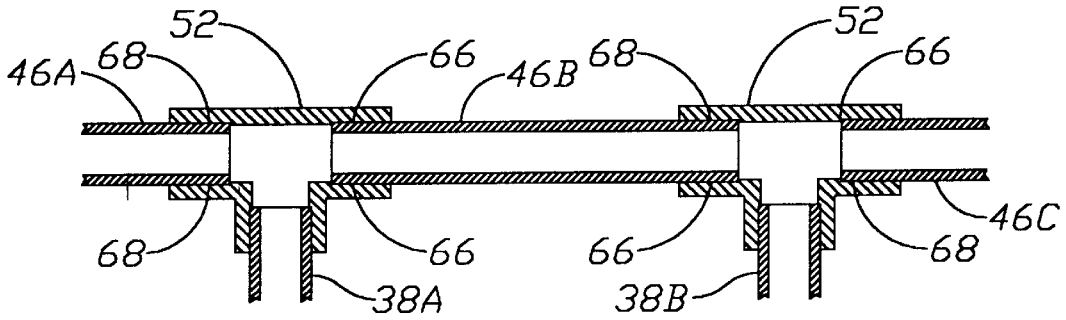
FIG. 4 is a sectional view along the lines A—A of FIG. 3.

A typical connection between the tee connectors and segments is shown in FIG. 4 where a sectional view is shown of segments 46*a*, 46*b*, and 46*c* connected to receptacles of tee connector 52 located along a longitudinal axis tee connector 52. In one embodiment, adhesive is applied at 66 to fixedly connect segment 46*b* to tee connector 52. The connection between 46*a* and 46*c* with tee associated connector 52 is a friction fit allowing pivoting of the tee connector 50 and segment 46*b* about the longitudinal axis of tee connectors 52 and segments 46*a* and 46*c*. As those skilled in the art recognize, the pivoting relationship between tee connector 50 and segments 46*a* and 46*c* can be achieved by other known alternative arrangements. This description applies as well to the relationship of the other tee connectors and associated segments.

Bridge member 38 has two tubular sections 38*a* and 38*b*. The opposed ends of both sections are fixedly connected to lateral receptacles of tee connectors 52 and 64, respectively, extending perpendicularly from the longitudinal axis of connectors 52 and 64. Bridge 40 has two tubular sections 40*a* and 40*b*. One opposed end of tubular sections 40*a* and 40*b* are fixedly connected to the lateral receptacles of tee connectors 52. The other opposed end of the tubular sections 40*a* and 40*b* are slideably and removably disposed within the lateral receptacles of tee connectors 64. The bridge members 38 and 40 support the outer rectangular member 34 and the inner rectangular member 36 in a spaced, concentric and parallel relationship.

All connections made to elbow connectors 50 and 62 and fixedly secured connections to tee connectors 52 and 64 are secured with adhesive suitable for polyvinyl chloride.

The tubular and connector portions of the assembly 20, namely, side members, bridge members, segments, legs, tee connectors and elbow connectors are preferably constructed of polyvinyl chloride. The tubular portions preferably have and inside radius diameter of ½ inches and an outside radius diameter of ⅞ inches. The tee connectors and elbow connectors have an outside radius diameter of 1⅛ inches. Where tee connectors and elbow connectors are connected to rectangular members, bridge members and segments, the receptacles of the tee connectors and elbow connectors are selectively sized to receive the ends of rectangular members, bridge members and segments in a friction fit with adhesive applied to the connection where the connections are fixedly secured.

As recognized by those skilled in the art, the assembly 20 may be constructed of other materials such as metal and other means or fasteners used to securely fasten the connectors either permanently or selectively to allow the assembly 20 to be assembled and disassembled, and it is intended that the invention cover such alternatives.

Figure 5:
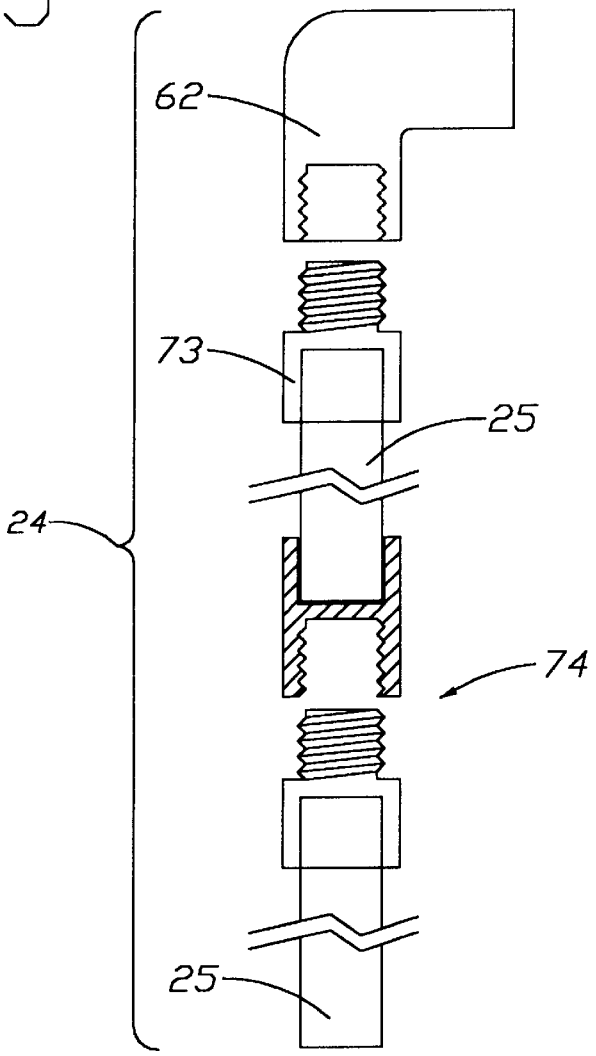
FIG. 5 is a sectional view of segments along line B—B of FIG. 2.

As seen in FIG. 5, the four legs 25 of base 24 each have a threaded top end connectible to a threaded receptacle at 73 in the connector 64. In an embodiment of the invention to adapt to bags of various heights, the legs 25 have a detachable fitting 74 to vary the length of the base 24 by detaching segments of equal length from each leg 25.

Figure 6A:
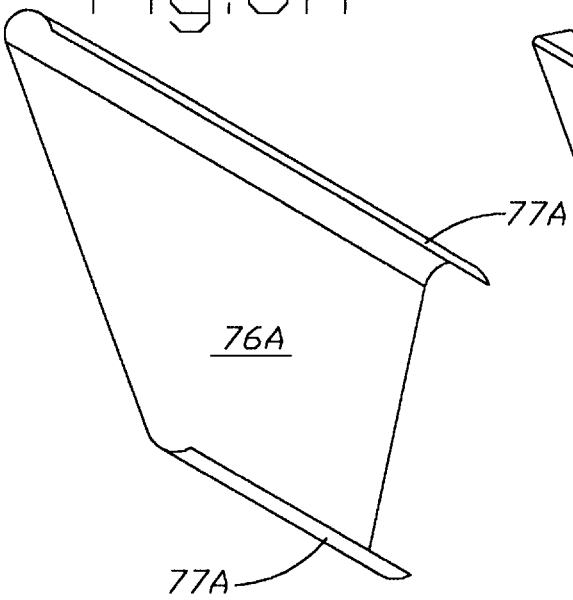
FIGS. 6*a* and 6*b* are perspective views of a funnel panel according to the present invention.
Figure 7A:
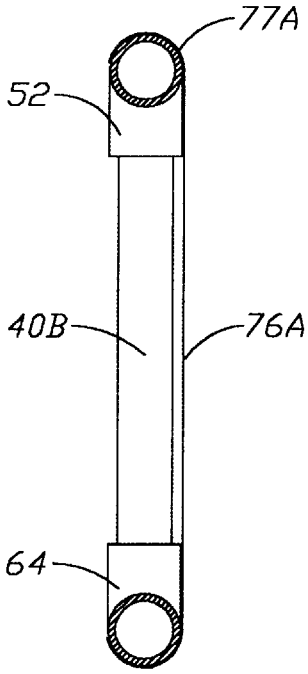
FIG. 7*a* is a sectional view along line C—C of FIG. 2.

As best shown in FIGS. 1, 2, 6*a*, and 7*a*, the liner 28 has four detachable panels 76*a*. The panels 76*a* are preferably constructed of resilient plastic material. The panels 76*a* have a generally trapezoidal shape and engaging edges 77*a* along the opposed parallel sides of each panel 76*a*. The engaging edges 77*a* have a generally arcuate cross section as shown in FIGS. 6*a* and 7*a*.

Figure 6B:
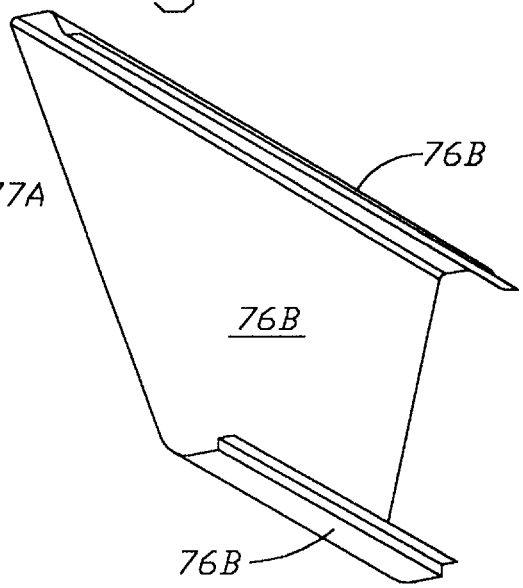
Figure 7B:
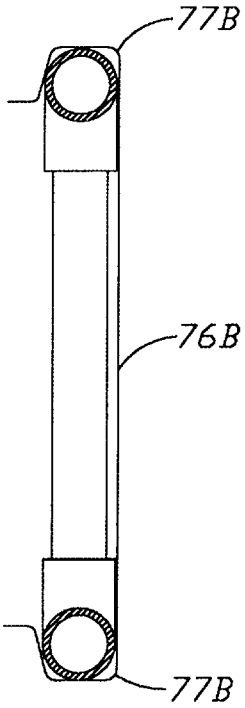
FIG. 7*b* shows a representative view depicting another embodiment according to the present having metal panels and its appearance in a view corresponding to the view of FIG. 7*a;*

In another embodiment shown in FIGS. 6*b* and 7*b*, panels 76*b* are constructed of metal having a generally trapezoidal shape and formed engaging edges 77*b* having a generally curved cross section. FIG. 7*b* illustrates how the metal panel 76*b* would appear in a view corresponding to the view of the panel 76*a* shown in FIG. 7*a*, and the following discussion pertaining to the operation of the panels 76*a* with other elements of the assembly 20 corresponds to the operation on the metal panels 76*b*.

As shown in FIGS. 1–3, the support structure 26 is in an extended or open position or configuration for connection to the panel 76*a* of liner 28. When the support structure 26 is in the extended position, the panels 76*a* are connected to the support structure 26 by connecting the engaging edges of the panels 76*a* to rectangular members 34 and 36. Specifically, the inner side of each engaging edge engages the surfaces a elbow connectors or elbow connectors and tee connectors.

FIG. 7*a* shows the connection of the panel 76*a* to tee connectors 52 and 64 of the support structure 26. The panel 76*a* shown in FIG. 7*a* also engages the elbow connectors 50 and 62 near the opposed ends of each edge of the panels 76*a*. The other adjacent and opposed panels 76*a* extending along sides 44 and 54 and along sides 44 and 54 only engage the elbow connectors 50 and 62. The panels 76*a* are selectively sized so that the resilient characteristics of the panels 76*a* hold the panels 76*a* securely by flexing the engaging edges 77*a* of the panels 76*a* over the rectangular members 34 and 36 of the support structure 26.

Figure 8A:
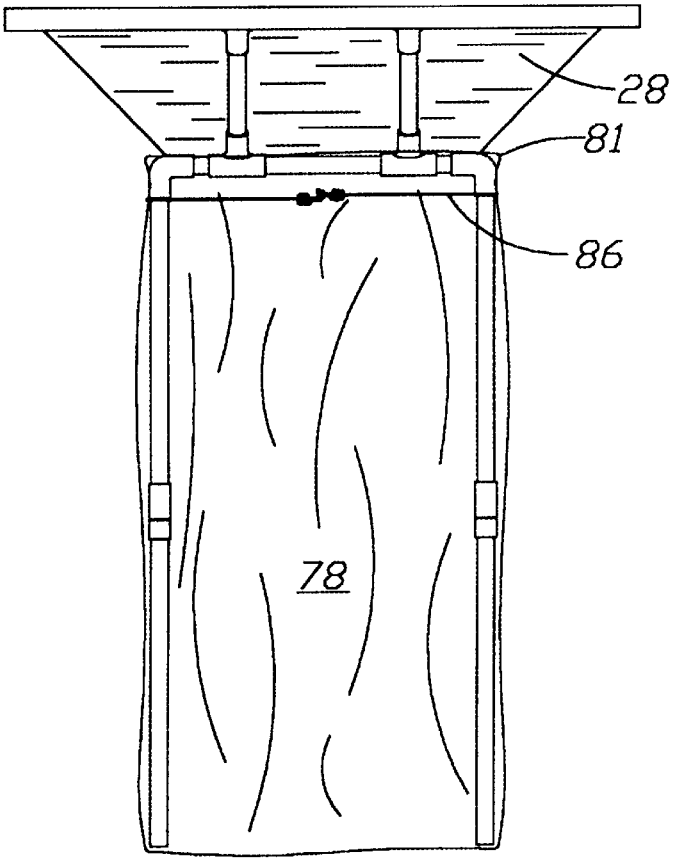
FIG. 8*a* is a view a bag support assembly according to the present invention.
Figure 8B:
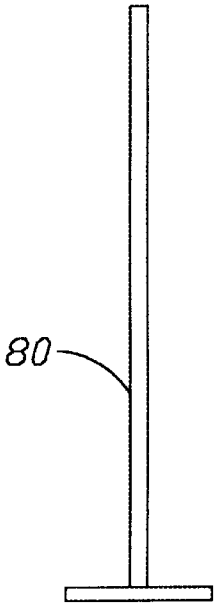
FIG. 8*b* is a view of a tamper for use with the bag support assembly.

FIG. 8*a* shows the assembly 20 connected to a trash bag 78, and FIG. 8*b* shows a tamper 80 for compacting trash such as grass clippings or leaves as the trash bag 78 is filled. The trash bag 78 is representative of the paper composition containers increasingly required by governmental bodies for use by homeowners disposal of garden waste such as grass clippings and leaves. The standard dimensions of these bags are 12 inches by 16 inches and 36 inches high.

The dimensions of the base 24 are selectively sized so that legs 25 of the base 24 are disposed in the trash bag 78 with each leg 25 near an inner corner of the trash bag 78 but without applying pressure to the inner sides of the trash bag 78. The legs 25 are sized so that the top of the bag 78 extends to a lower side of lower rectangular member 36 as shown at 81 in FIG. 8. To obtain the desired fit between the upper inner edge of the bag 78 and the lower rectangular member 36, overall dimensions 82 and 84 are preferably 11¾ to 11⅞ inches and 15¾ to 15⅞ inches, respectively, measured to the outer surface of the elbow connectors 50. The legs 25 of the base 24 are preferably 36 inches in length when used with the paper trash bag 78. The bottom of legs 25 rest on the bottom of the paper trash bag 78 and are positioned proximately to the vertical corners of the paper trash bag 78, thus restraining the paper trash bag 78 from lateral displacement away from the inner end 32 of the funnel 22

Further FIG. 8 shows, in phantom view, a securing apparatus 86.

While the paper trash bag 78 described above does not require a securing apparatus, such securing apparatus for cinching a trash bag to the assembly 20 may be helpful particularly for use with plastic trash bags or other trash bags lacking adequate rigidity.

Figure 10:
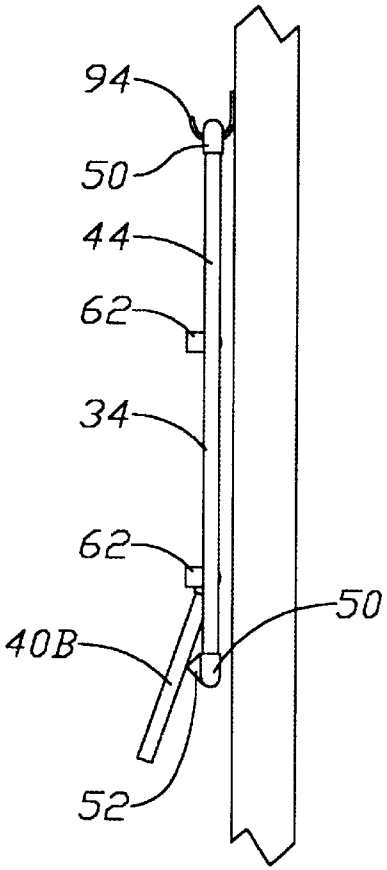
FIG. 10 is a side view of the assembly according to the present invention shown in FIG. 5.
Figure 9:
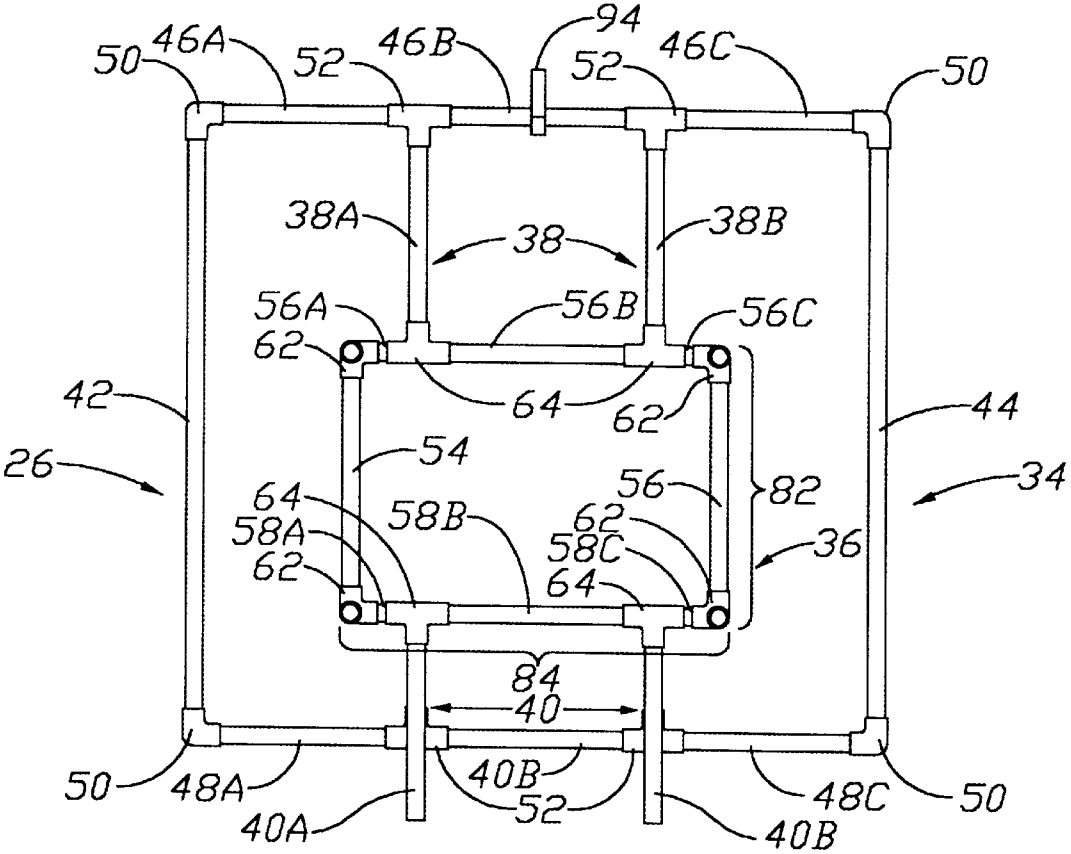
FIG. 9 is a view of the frame of the assembly according to the present invention have funnel panels removed and folded for storage.

To store the assembly 20, the panels 76*a* are removed, and the support structure 26 is converted from the extended or open configuration to a compressed or relatively low profile closed position by slidably removing the ends of the tubular sections 40*a* and 40*b* of bridge member 40 from the tee receptacle end of associated tee connectors 52. Upon disengagement of the ends of the tubular sections 40*a* and 40*b*, the bridge member 40 is free to pivot about its connection to connectors 64 at the inner rectangular member 36, and the bridge member 38 is to pivot about its connections at connectors 52 and 64 in the outer rectangular member 34 and the inner rectangular member 36 respectively. Thus, the rectangular member 36 and the bridge members 38 and 40 are then moved to the compressed or low profile position as shown in FIGS. 9 and 10.

Figure 12:
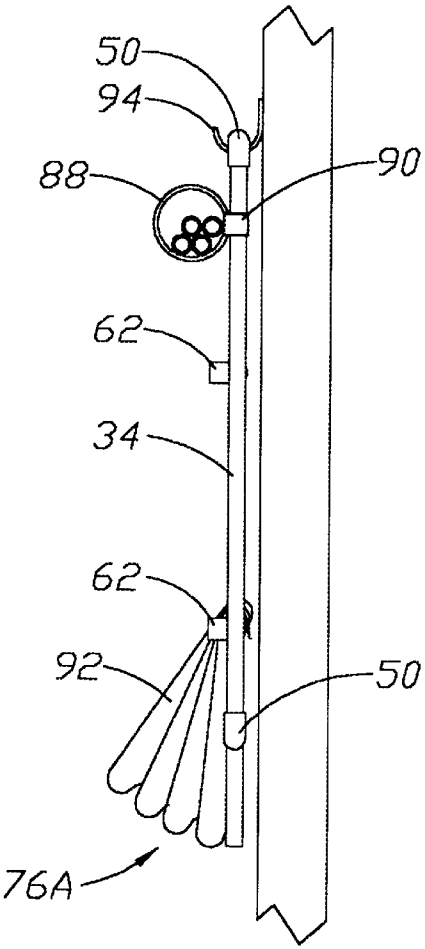
FIG. 12 is a side of the assembly according to the present invention show in FIG. 11.
Figure 11:
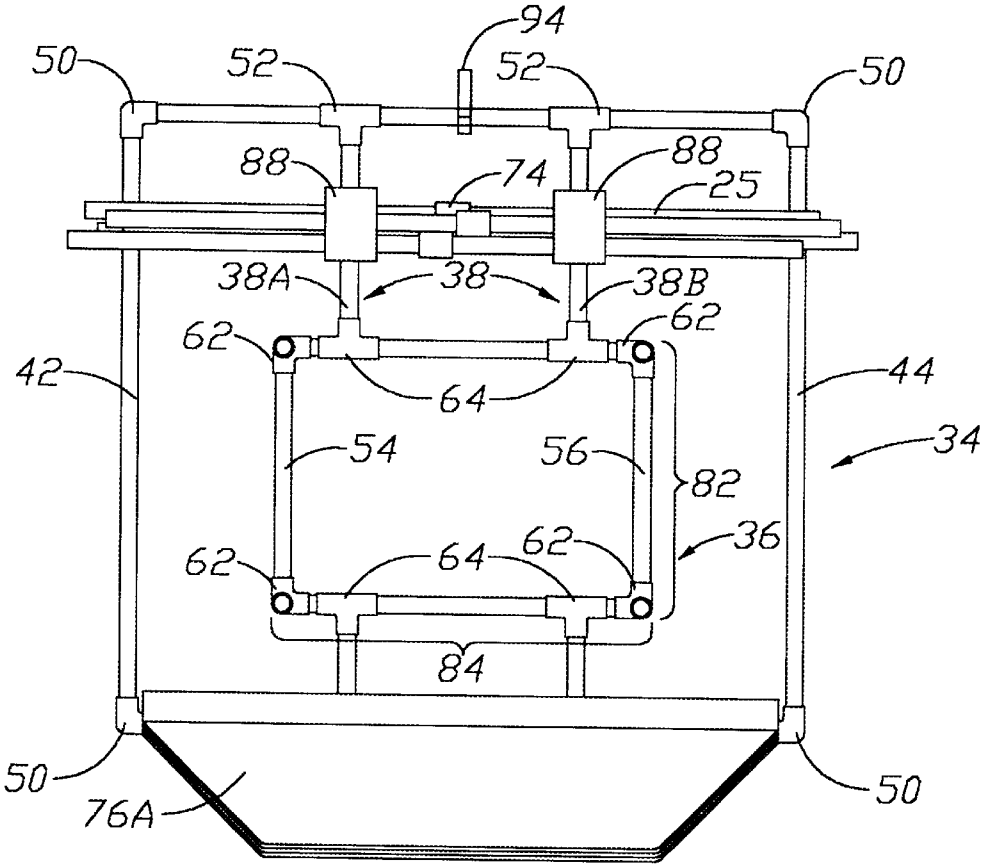
FIG. 11 is a view of the assembly according to the present invention adapted to store legs of the base and the funnel panels.

In one embodiment shown FIGS. 11 and 12, storage loops 88 are attached to the fixed bridge members 38 with a flexible cord 90 to hold the storage loops 88 securely to tube members 38*a* and 38*b*. The legs 25 are shown in the stored configuration positioned within the loops 88.

For storage, the detached panels 76*a* are preferably connected to segments 48*a*, 48*b*, and 48*c* associated with the bridge member 40 in nesting or nestling arrangement 92 as best seen in FIG. 12. The assembly 20 may then be stored on a hook 94 as shown in FIGS. 10 through 12.

In another embodiment, bridge member 40 is fixedly secured to tee connector 64 so that the support structure 26 is always in the extended or open configuration. In this embodiment, the panels 76*a* are selectively removed storage.

In yet another embodiment, an assembly of the present invention is marketed as a kit with the assembly 20 comprising discreet pieces of tubular sections, connectors, a liner, and adhesive so that the purchaser and assemble and construct the assembly 20.

Those skilled in the art who now have the benefit of the present disclosure will appreciate that the present invention may take many forms and embodiments. Some embodiments have given described so as to give an understanding of the invention. It is intended that these embodiments should be illustrative, and not limiting of the present invention. Rather, it is intended that the invention cover all modifications, equivalents and alternatives falling within the spirit and scope of the invention as defined by the appended claims.

What is claimed is:

1. A bag support assembly for supporting and filling a trash bag, comprising: a funnel having an outer end for receiving trash and an inner end for discharging the trash into the trash bag, and wherein, the funnel includes a support structure and a liner connected to the support structure and the liner having engaging edges along the outer and inner ends and removably connected to the support structure; and a base for providing support to the funnel in a position overlying an open end of the base with a plurality of legs for sliding insertion into the trash bag to rest on a bottom of the trash bag.

2. The bag assembly recited in claim 1, including means for securing the bag to the base.

3. The bag support assembly recited in claim 1, wherein the liner comprises a plurality of panels.

4. The bag support assembly recited in claim 3, wherein the panels have a generally trapezoidal shape.

5. The bag support assembly recited in claim 4, wherein the panels are resiliently mounted to the support structure.

6. A bag support assembly, comprising:

a funnel collapsible from an open configuration for use to a relatively low profile closed configuration when not in use;

a base for supporting the funnel when in the open configuration in an overlying loading relationship with respect to a bag;

a collapsible frame;

a plurality of panels releasably attachable to different parts of the collapsible frame to form a funnel surface when in an open configuration for guiding refuse to an open end of the bag; and means for attaching the plurality of panels to a same part of the collapsible frame while in nestled relationship with one another.

7. A bag support assembly for supporting and filling a trash bag, comprising:

a support structure having an outer rectangular member and an inner rectangular member and a bridge member for securing the outer rectangular member and the inner rectangular member in a generally spaced relationship;

a liner defining a funnel surface and having an outer end for receiving trash connected to the outer rectangular member and an inner end for discharging trash connected to the inner rectangular member; and a base for providing support to the funnel in a position overlying an open end of the base with a plurality of spaced apart legs adapted for sliding insertion into the trash bag to rest on a bottom of the trash bag while giving sides of the trash bag lateral support.

8. The bag support assembly recited in claim 7, wherein the liner is removably connected to the support member and the bridge member is removably connected to at least one of the rectangular members, the rectangular members being movable toward each other to reduce the relative distance between the rectangular members when the rectangular members are disconnected from the liner.

9. The bag support assembly recited in claim 8, wherein the bridge member is a pair of connecting members having opposed ends connected to the outer rectangular member and inner rectangular member with one opposed end being removably connected and the other one of the opposed ends being pivotally connected.

10. The bag support assembly recited in claim 7, wherein the bridge member secures the outer rectangular member and the inner rectangular member in a generally concentric relationship.

11. The bag support assembly recited in claim 7, wherein the bridge member secures the outer rectangular member and the inner rectangular member in a generally parallel relationship.

12. A kit for a bag support assembly capable of being assembled by a purchaser, comprising;

a plurality of connectors;

a support structure comprising:

(i) a first group of pieces adapted to be assembled into an outer rectangular member when fixedly secured by a selected portion of the connectors (ii) a second group of pieces adapted to be assembled into an inner rectangular member when fixedly secured by the remaining connectors;

(iii) a third group of pieces adapted to be assembled into a bridge member connecting the outer rectangular member and inner rectangular member in concentric, parallel and spaced relationship;

a liner defining a funnel surface having an outer end for receiving trash connected to the outer rectangular member and an inner end for discharging trash connected to the inner rectangular member;

a fourth group of pieces adapted to be assembled into a base and connected to the support structure when assembled; and means for selectively securing the connectors to the pieces when the assembly is in use by the purchaser.

13. A kit for a bag support assembly capable of being assembled by a purchaser, comprising:

an outer rectangular member;

an inner rectangular member;

a bridge member connected to the rectangular members and holding the rectangular members in a open relationship when in use and in a low profile closed relationship when not in use;

a liner defining surface selectively connectable to the rectangular members when the rectangular members are in the open position; and a base for supporting the rectangular members when in the open relationship and liner is in an overlying loading relationship with respect to the bag.

* * * * *